US005344372A

United States Patent [19]

Hung

[11] Patent Number: 5,344,372

[45] Date of Patent: Sep. 6, 1994

[54] TREADMILL WITH COLLAPSIBLE HANDRAILS

[76] Inventor: Michael Hung, 9-16, Nan Kan Hsia, Nan Kan, Lu Chu Hsiang, Tao Yuan County, Taiwan

[21] Appl. No.: 151,988

[22] Filed: Nov. 15, 1993

[51] Int. Cl.[5] ..... A63B 22/02

[52] U.S. Cl. ..... 482/54; 482/52

[58] Field of Search ..... 482/54, 52, 53, 41, 482/42, 69, 70, 71

[56] References Cited

U.S. PATENT DOCUMENTS

| | | | |
|---|---|---|---|
| 4,342,452 | 8/1982 | Summa | 482/54 |
| 4,548,405 | 10/1985 | Lee et al. | 482/54 |
| 4,643,418 | 2/1987 | Bart | 482/54 |
| 4,759,540 | 7/1988 | Yu et al. | 482/54 |
| 5,162,029 | 11/1992 | Gerard | 422/54 |
| 5,195,935 | 3/1993 | Fencel | 482/52 |
| 5,207,622 | 5/1993 | Wilkinson et al. | 482/54 |
| 5,282776 | 2/1994 | Dalebout | 482/54 |

*Primary Examiner*—Richard J. Apley
*Assistant Examiner*—Lynne A. Reichard
*Attorney, Agent, or Firm*—Wenderoth, Lind & Ponack

[57] ABSTRACT

A step exercising machine includes a front upright frame and a rear upright frame mounted on the machine base thereof at tow opposite ends, that can be collapsed when the respective mounting screw bolts are removed, two rollers mounted around two axles fixed between two holder frames on two opposite sides of the machine base to hold a track, a bottom board mounted on the machine base by screw bolts and spring washers and disposed below the track to bear the pressure of the player.

5 Claims, 11 Drawing Sheets

TREADMILL WITH COLLAPSIBLE HANDRAILS

BACKGROUND OF THE INVENTION

The present invention relates to an improved structure of step exercising machine which can be collapsed to minimize its storage space when not in use, and which has means to bear the pressure of the player and simultaneously to absorb or lessen shocks.

Various step exercising machines have been disclosed for training the muscles of the legs, and have appeared on the market. These step exercising machines are commonly heavy and difficult to assemble. When assembled, they cannot be collapsed or folded up. Therefore, these step exercising machines need much storage space during their delivery. During the operation, the pressure of the player is directly and completely distributed through the machine base causing the machine base to shake, and therefore the frame structure of the machine base may be damaged easily.

SUMMARY OF THE INVENTION

The present invention has been accomplished to provide a step exercising machine which eliminates the aforesaid problems. According to one aspect of the present invention, the step exercising machine is generally comprised of a machine base, a track, two rollers transversely mounted on the machine base to hold the track, a front upright frame and a rear upright frame mounted on the machine base at two opposite ends, a first horizontal handrail and a second horizontal handrail respectively connected between the front and rear upright frames at either side at the top, a bottom board mounted on the machine base below the track, and a control panel mounted on the first horizontal handrail for controlling the operation of the step exercising machine, wherein the front upright frame comprises a bottom cross bar retained between two mounting frames on two opposite side bars of the machine base by clamping plates, and two upright tubes having a respective horizontal lug at the bottom fixed to either side bar of the machine base by a respective screw bolt; the rear upright frame comprises a bottom cross bar retained between the two side bars of the machine base at the bottom by clamping plates; the front and rear upright frames can be collapsed when the horizontal lugs of the front upright frame or the clamping plates on the rear upright frame are loosened. According to another aspect of the present invention, the side bars of the machine base have a respective row of screw nuts fastened in respective holes thereof; the bottom board comprises two rows of through holes at two opposite sides respectively connected to the row of screw nuts on either side bar of the machine base by screw bolts and spring washers. Therefore, the bottom board bears the pressure of player, and the spring washers absorb or lessens shocks during the operation of the step exercising machine. According to still another aspect of the present invention, the rollers are respectively turned on a respective axle having two opposite ends fixed to two opposite C-shaped holder frames on the side bars of the machine base.

DETAILED DESCRIPTION OF THE PREFERRED EMBODIMENT

Figure 1:
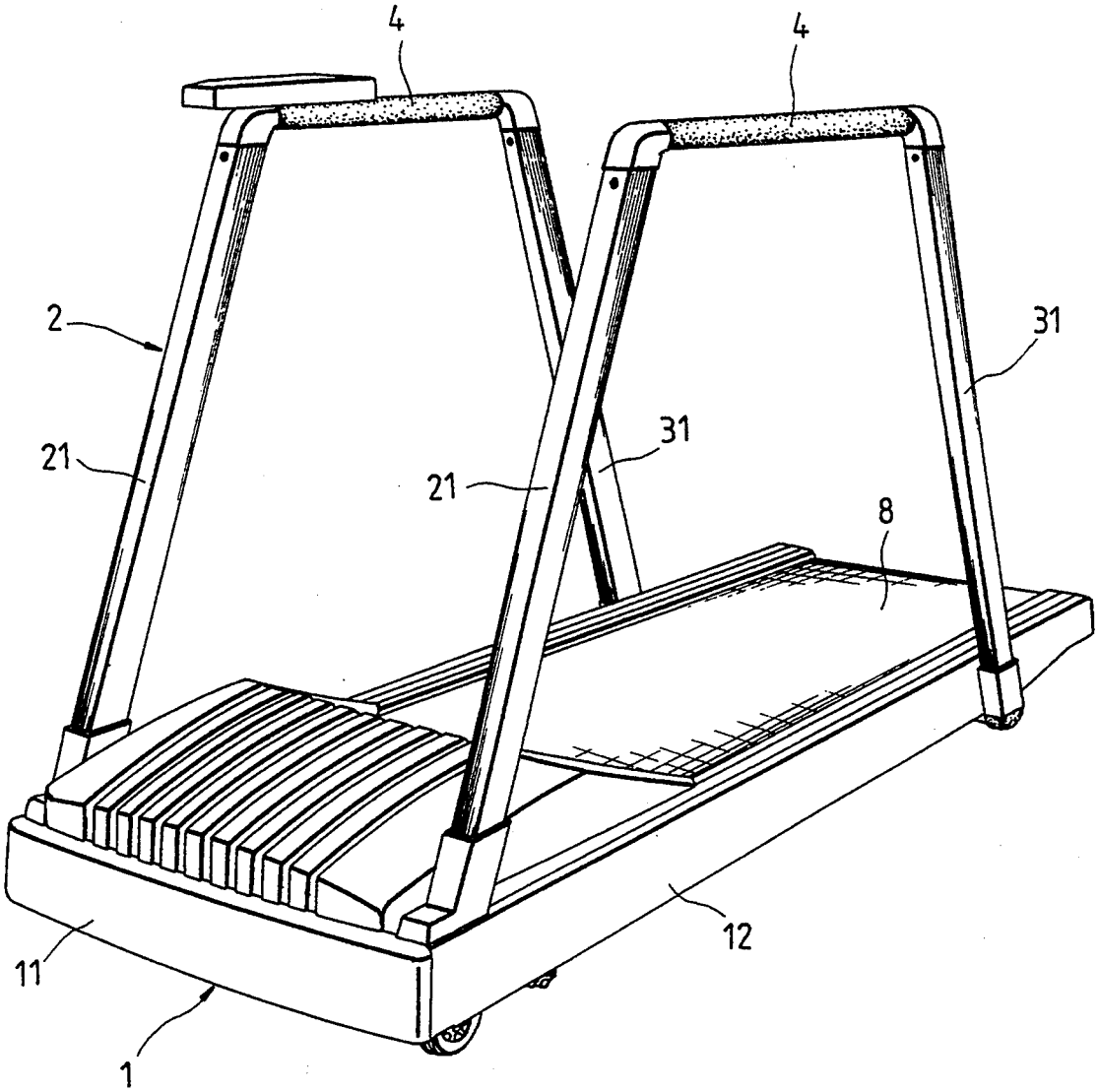
FIG. 1 is an elevational view of a step exercising machine according to the preferred embodiment of the present invention.

Referring to the annexed drawings in detail, a step exercising machine in accordance with the preferred embodiment of the present invention is generally comprised of a machine base 1, a front upright frame 2, a rear upright frame 3, two horizontal handrails 4, a control panel 5 mounted on one horizontal handrail, rollers 6, a bottom board 7, and a track 8.

Figure 2:
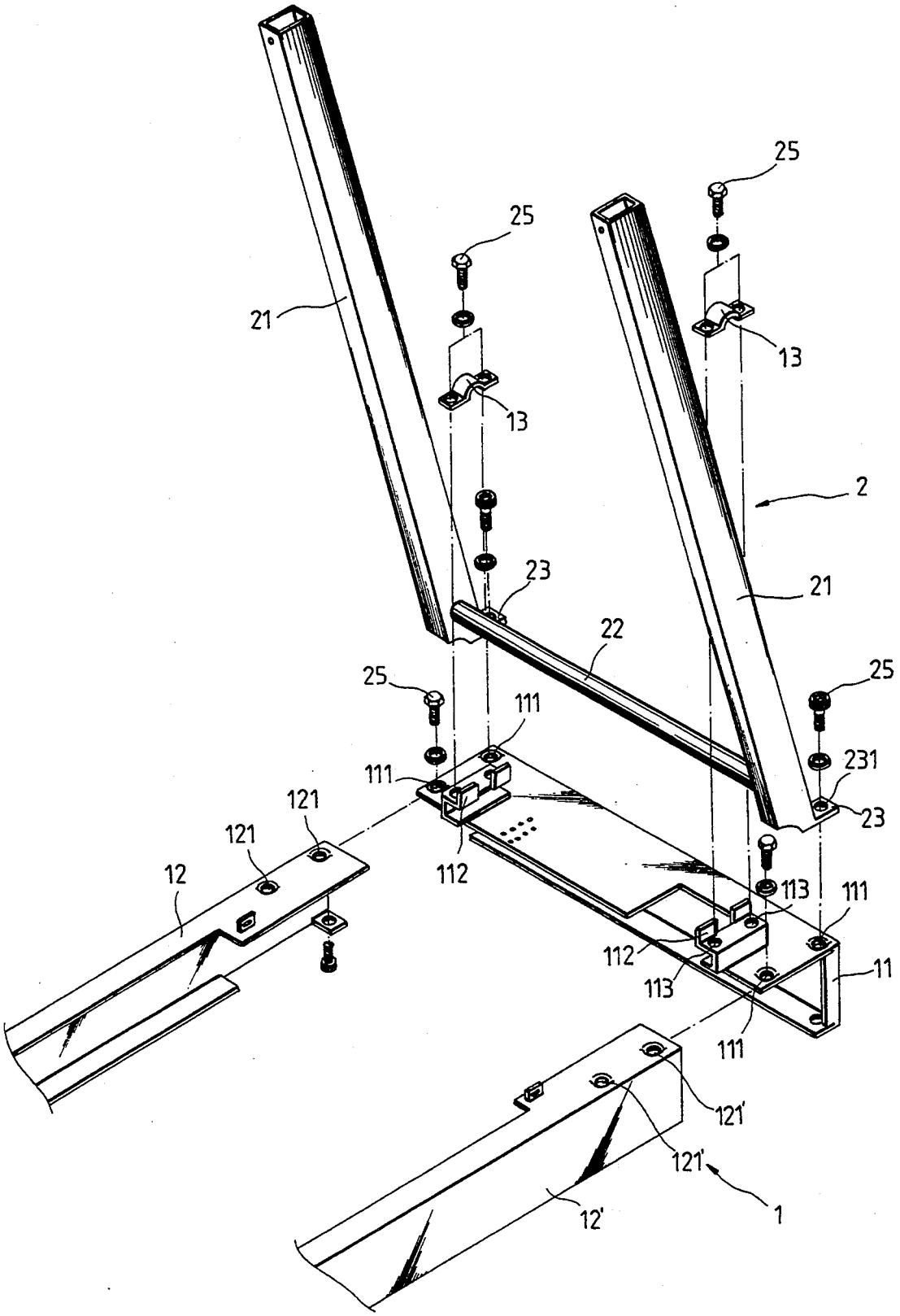
FIG. 2 is an exploded view of the front upright frame of the step exercising machine shown in FIG. 1.
Figure 3:
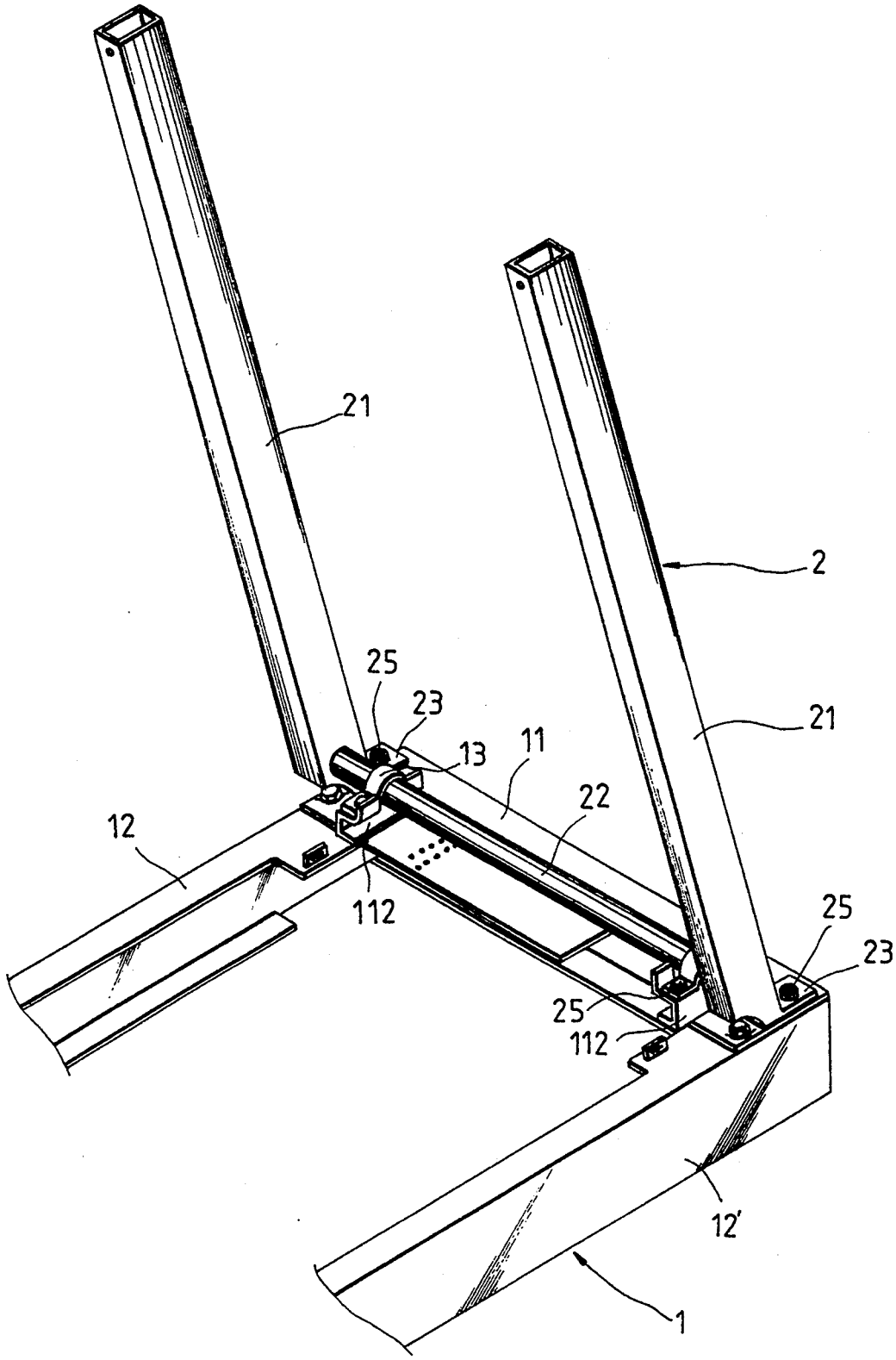
FIG. 3 is an assembly view of the front upright frame of FIG. 2.
Figure 4:
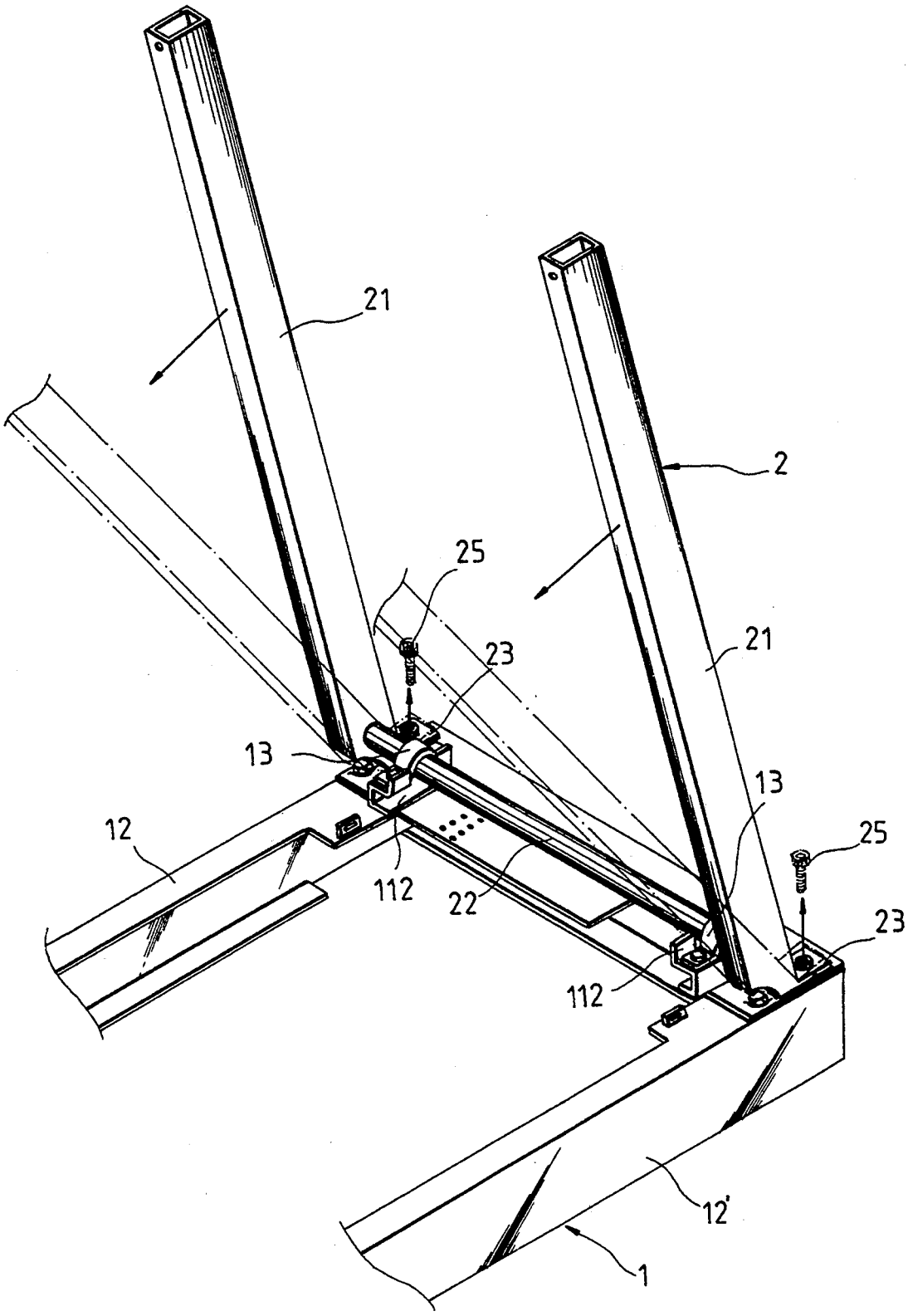
FIG. 4 shows the front upright frame of FIG. 3 turned to the collapsed position.

Referring to FIGS. 2, 3, and 4, the machine base 1 comprises a front cross bar 11, and two parallel side bars 12;12' perpendicularly extended from two opposite ends of the front cross bar 11 in the same direction on the same plane. The side bars 12;12' have respective countersunk holes 121;121' vertically aligned with respective countersunk holes 111 on either end of the front cross bar 11 and fastened together by screw bolts 25. Two mounting frames 112 are spaced on the front cross bar 11 at the top, having each two spaced screw holes 113. A respective clamping plate 13 is fastened to the screw holes 113 on either mounting frame 112 to hold the front upright frame 2 in place. The front upright frame 2 comprises two upright tubes 21, and a bottom cross bar 22 connected between the upright tubes 21 at the bottom and retained to the front cross bar 11 by the clamping plates 13. Each upright tube 21 has a horizontal lug 23 with a screw hole 231 fastened to a corresponding countersunk hole 121 or 121' on either side bar 12 or 12' and a corresponding countersunk hole 111 on either end of the front cross bar 11. By removing the respective screw bolts 25 from the horizontal lugs 23 of the upright tubes 21, the front upright frame 2 can be turned on the longitudinal axis through the bottom cross bar 22, and therefore the front upright frame 2 can be turned to a collapsed position closely attached to the base frame 1 to minimize the storage space of the step exercising machine during its delivery.

Figure 5:
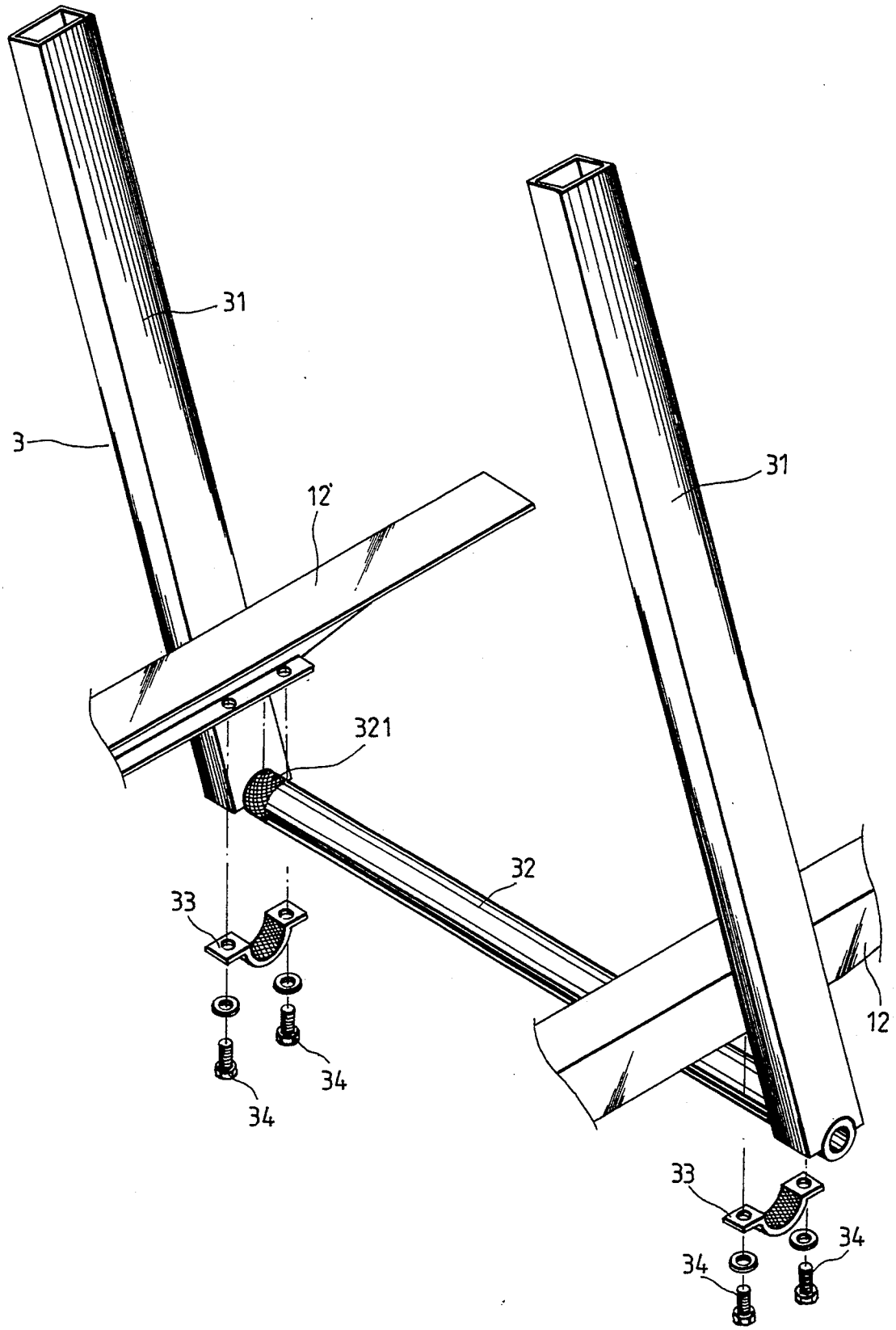
FIG. 5 is an exploded view of the rear upright frame of the step exercising machine shown in FIG. 1.
Figure 6:
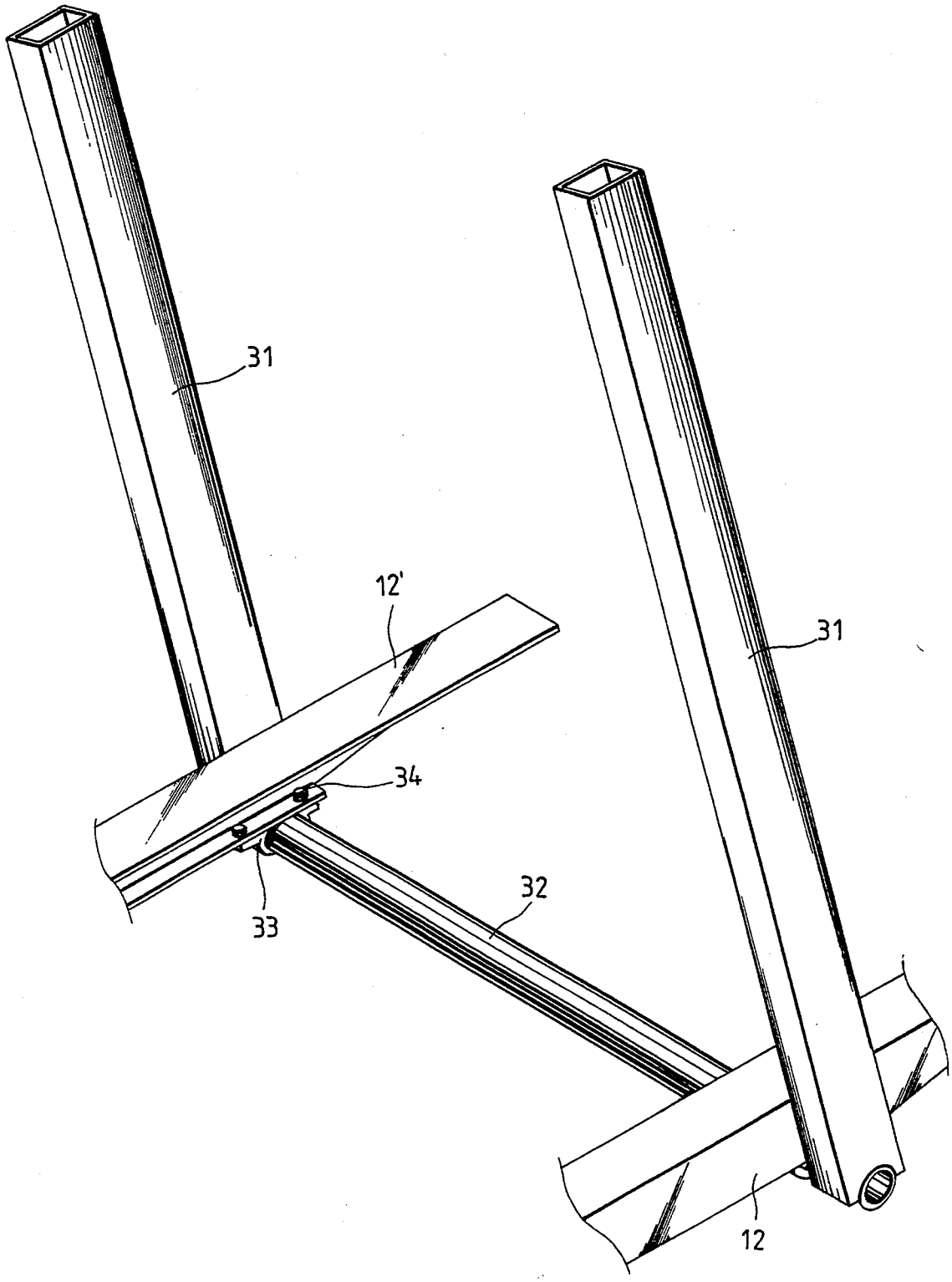
FIG. 6 is an assembly view of the rear upright frame of FIG. 5.
Figure 7:
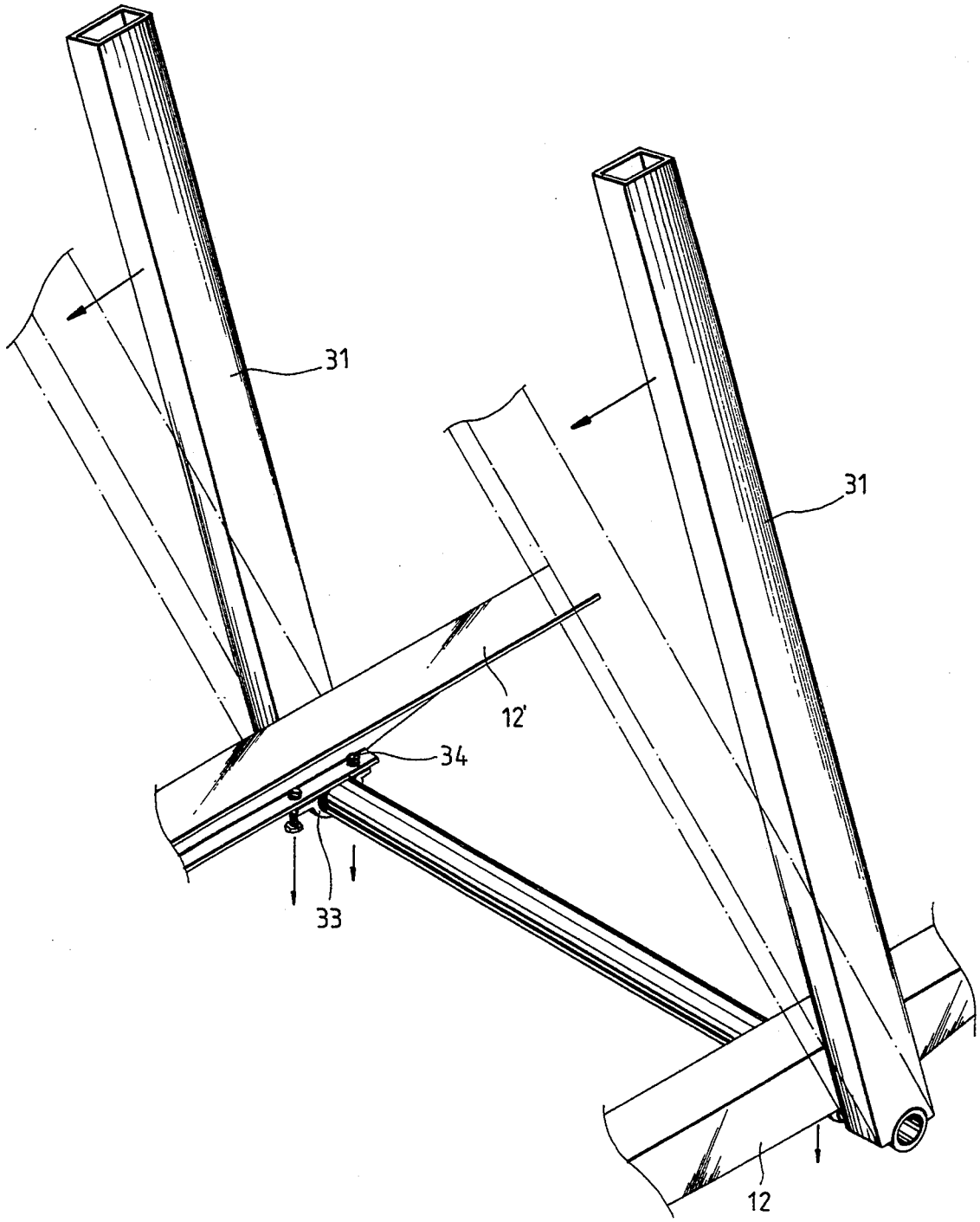
FIG. 7 shows the rear upright frame of FIG. 6 turned to the collapsed position.

Referring to FIGS. 5, 6, and 7, the rear upright frame 3 comprises two upright tubes 31, and a bottom cross bar 32 connected between the upright tubes 31 at the bottom and retained to the side bars 12;12' at the bottom by clamping plates 33 and screw bolts 34. The bottom cross bar 32 of the rear upright frame 3 has two embossed surface portions 321 spaced on two opposite ends thereof within the upright tubes 31 onto which the clamping plates 33 clamp respectively. By loosening the screw bolts 34, the rear upright frame 3 can be turned downward to a collapsed position with the upright tubes 31 thereof respectively attached to the side bars 12 of the base frame 1.

Figure 8:
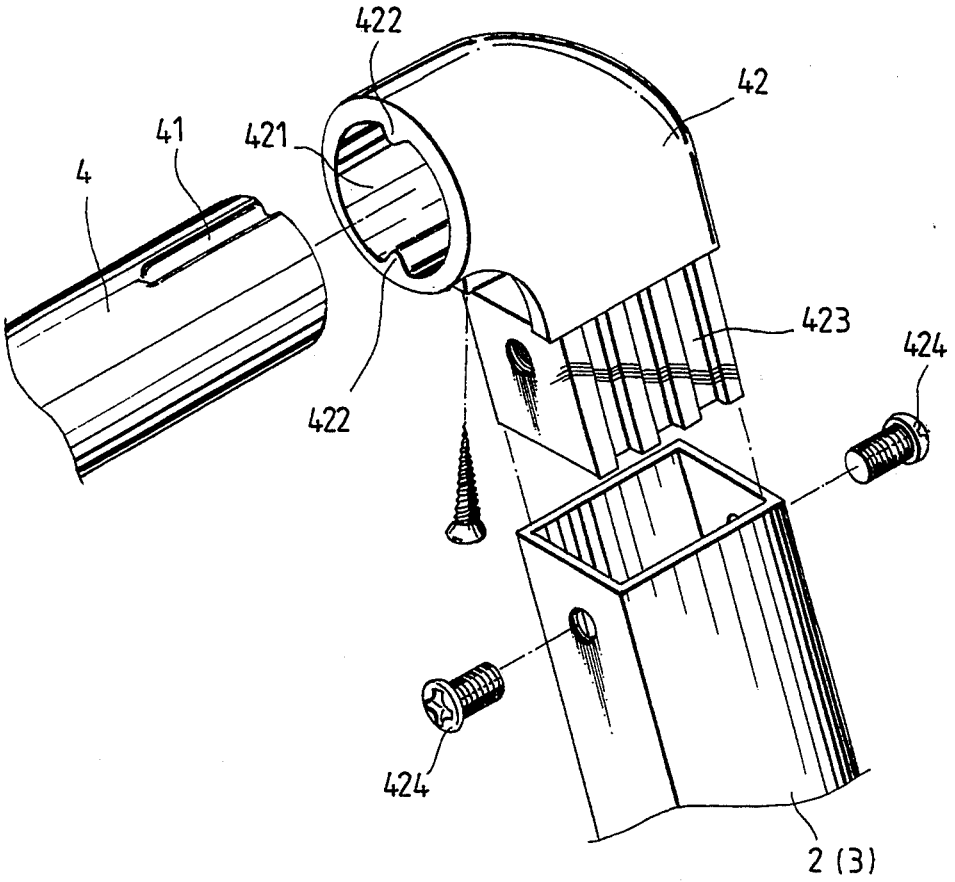
FIG. 8 is a partial exploded view of the step exercising machine of FIG. 1, showing the connection between one horizontal handrail handrail and one upright tube.
Figure 9:
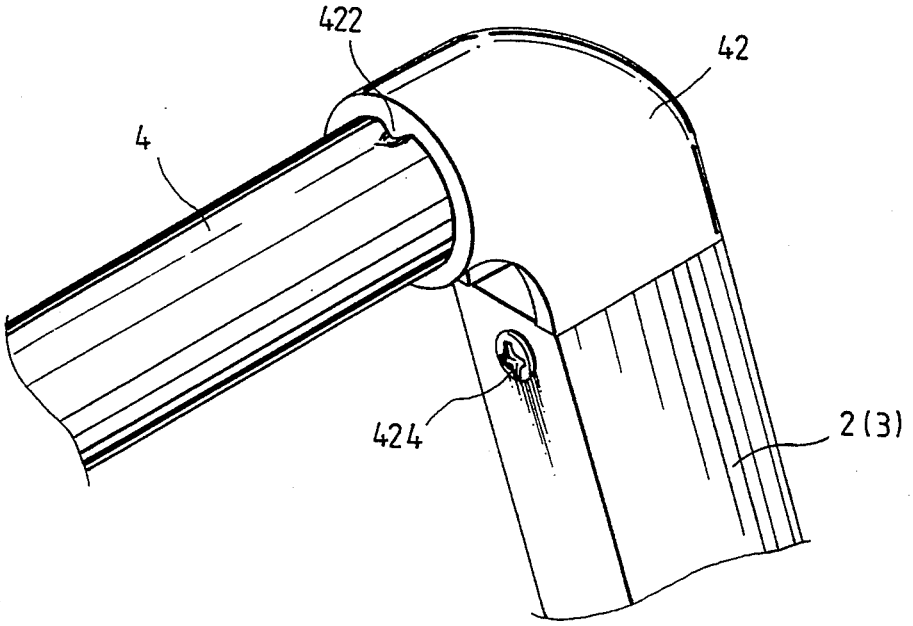
FIG. 9 is an assembly view of FIG. 8.

Referring to FIGS. 8 and 9, the horizontal handrails 4 are respectively and bilaterally connected between the upright tubes 21 of the front upright frame 2 and the upright tubes 31 of the rear upright frame 3 by angle connectors 42. The horizontal handrail 4 is made front a round rod having two opposite longitudinal grooves 41 at each end. The angle connector 42 comprises a plug hole 421 at one end, which receives either end of either horizontal handrail 4, and a plug rod 423 at an opposite end, which fits into either upright tube 21 or 31 of the front upright frame 2 or rear upright frame 3 and is then fixed in position by screws 424. Two opposite ribs 422 are raised from the inside wall of the plug hole 421 and respectively engaged into the two opposite longitudinal grooves 41 on either end of either horizontal handrail 4 to prohibit the respective horizontal handrail 4 from rotary motion relative to the respective angle connector 42.

Figure 10:
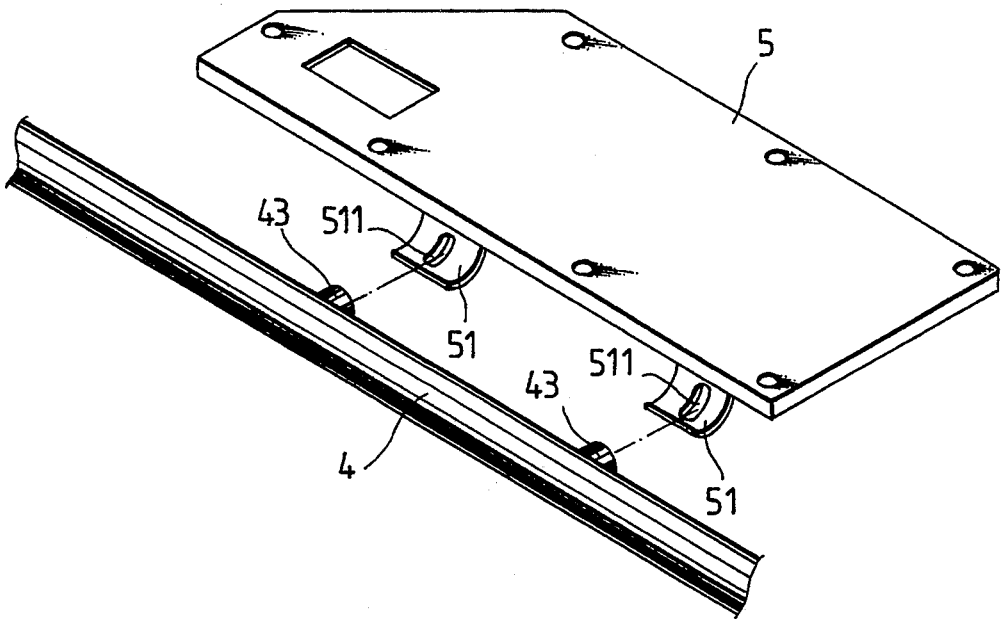
FIG. 10 is a partial exploded view of the step exercising machine of FIG. 1, showing the connection between the control panel thereof and one horizontal handrail thereof.
Figure 11:
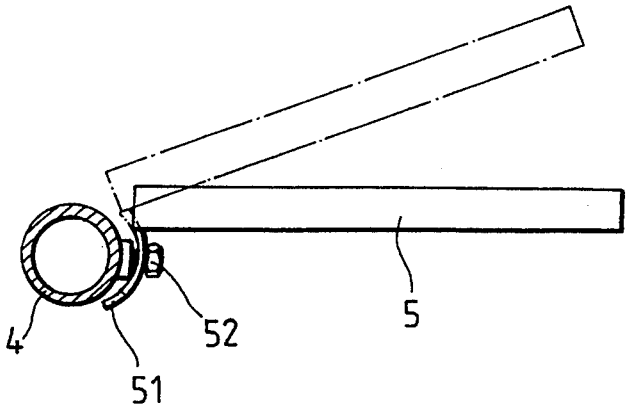
FIG. 11 shows the control panel adjusted on the horizontal handrail.

Referring to FIGS. 10 and 11, one horizontal handrail 4 comprises two screw holes 43 spaced on an outer side for mounting the control panel 5. The control panel 5 comprises two arched mounting lugs 51 having a respective elongated slot 511 respectively connected to either screw hole 43 on the horizontal handrail 4 by a respective adjusting screw 52. By loosening the adjusting screws 52, the angular position of the control board 5 on the horizontal handrail 4 can be adjusted.

Figure 12:
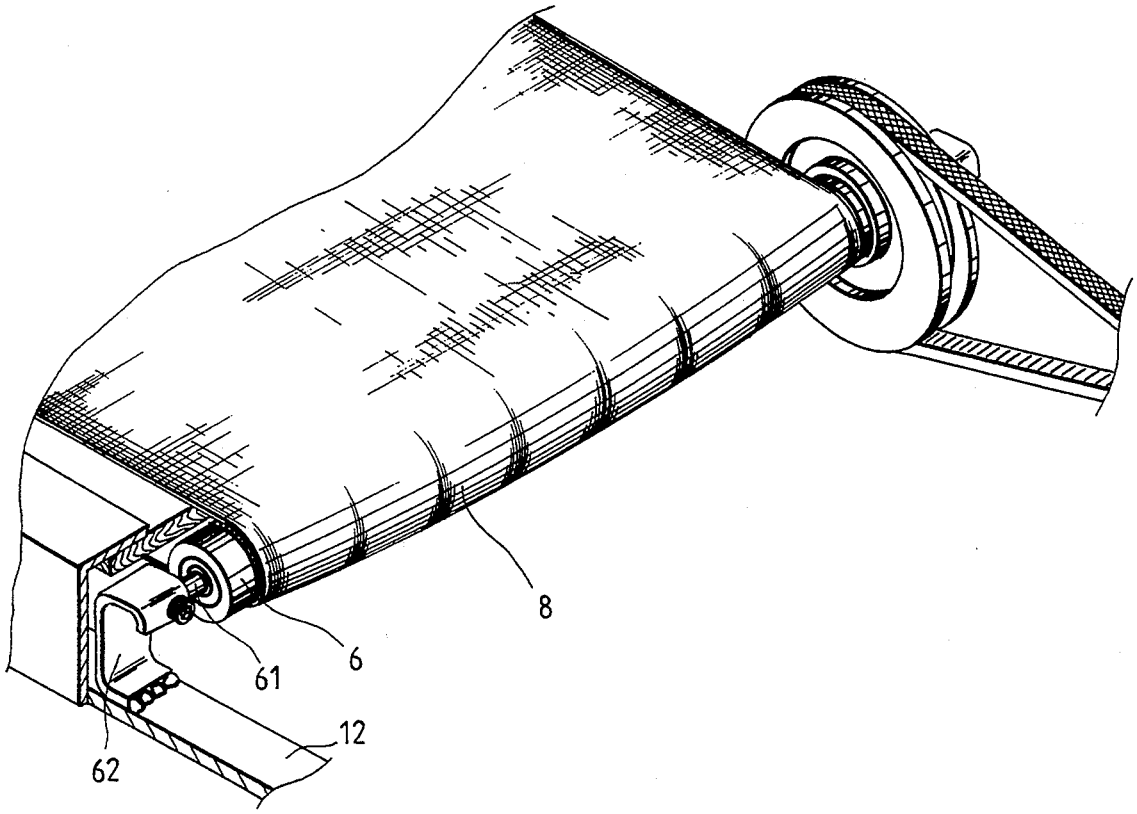
FIG. 12 is a cutaway showing the installation of the roller in the step exercising machine of FIG. 1.

Referring to FIG. 12, each roller 6 is mounted around a respective axle 61 fixed between two substantially C-shaped holder frames 62 on the two side bars 12;12' at either end to hold the track 8, therefore the rollers 6 are suspended between the side bars 12;12' of the machine base 1.

Figure 13:
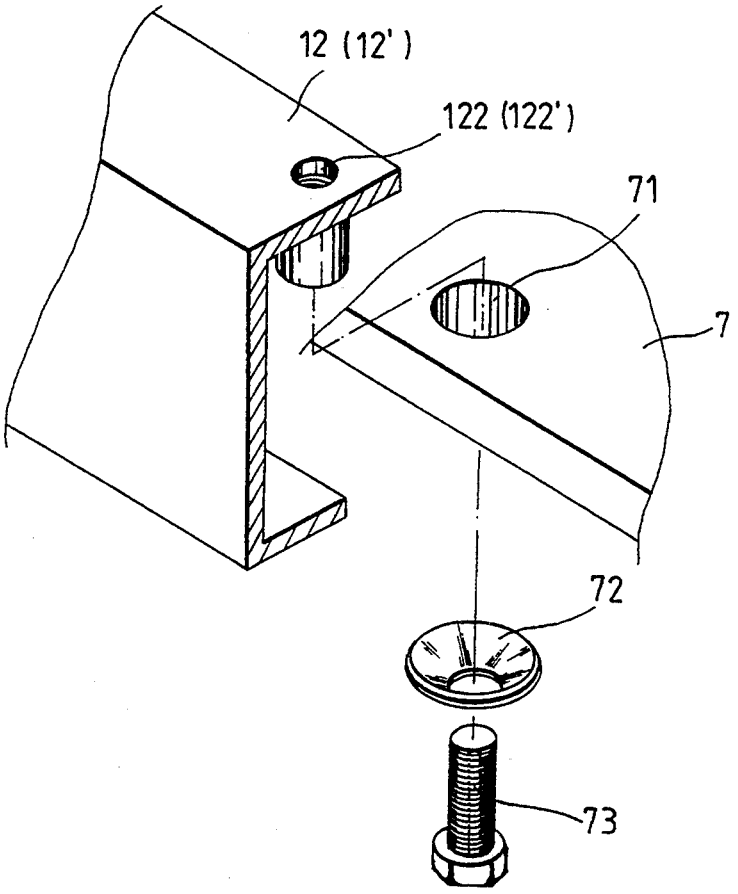
FIG. 13 is a partial exploded view of the step exercising machine of FIG. 1, showing the connection between the bottom board and either side bar of the machine base.
Figure 14:
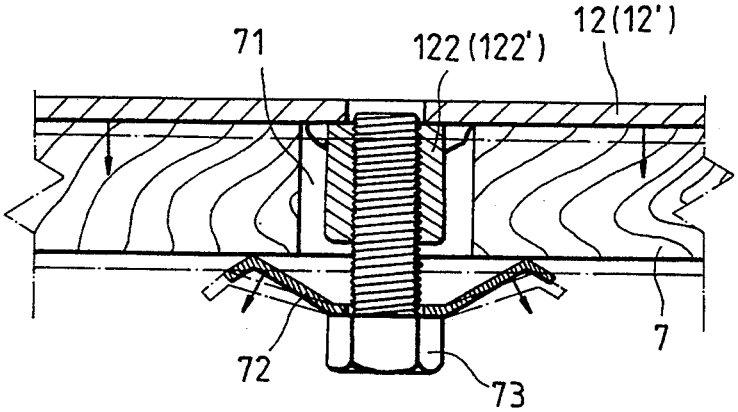
FIG. 14 is an assembly view in section of FIG. 13.

Referring to FIGS. 13 and 14, the bottom board 7 is mounted on the machine base 1 and connected between the side bars 12;12' below the track 8. The bottom board 7 comprises two rows of through holes 71 spaced along two opposite sides thereof. The side bars 12;12' have a respective row of screw nuts 122;122' respectively fitted into either row of through holes 71 on either side of the bottom board 7. A screw bolt 13 is inserted through a respective spring washer 72 and then threaded into each screw nut 122;122' to fasten the bottom board 7 and the side bars 12;12' together. As the player runs on the track 8, the pressure from the player is acted on the bottom board 7, and shocks are absorbed or lessened by the spring washers 72 on the screw bolts 73.

As indicated, the present invention provides a step exercising machine which can be collapsed to minimize its storage space during the delivery, and which has means to absorb or lessen shocks during its operation.

While only one embodiment of the present invention has been shown and described, it will be understood that various modifications and changes could be made without departing from the spirit and scope of the invention.

What is claimed is:

1. A step exercising machine comprising a machine base, a track, two rollers transversely mounted on said machine base to hold said track, a front upright frame and a rear upright frame mounted on said machine base at two opposite ends, a first horizontal handrail and a second horizontal handrail respectively connected between said front and rear upright frames at either side at the top, a bottom board mounted on said machine base below said track, and a control panel mounted on said first horizontal handrail for controlling the operation of the step exercising machine, wherein:

said machine base comprises a front cross bar, and two parallel side bars having a respective front end perpendicularly connected to said front cross bar at either end by screw bolts, said front cross bar comprising two mounting frames near two opposite ends thereof at the top;

said front upright frame comprises two upright tubes, and a bottom cross bar connected between the upright tubes thereof at the bottom and retained to said mounting frames of said front cross bar of said machine base by first clamping plates, each first clamping plate being bridged over the bottom cross bar of said front upright frame and having two opposite ends fastened to either mounting frame by screw bolts; and said rear upright frame comprises two upright tubes, and a bottom cross bar connected between the upright tubes thereof at the bottom and retained to said side bars of said machine base at the bottom by second clamping plates, the bottom cross bar of said rear upright frame having two embossed surface portions spaced near two opposite ends thereof onto which said second clamping plates respectively clamp, each second clamping plate being bridged over the bottom cross bar of said rear upright frame and having two opposite ends fastened to either side bar of said machine base by screw bolts.

2. The step exercising machine of claim 1 wherein said first and second horizontal handrail are respectively connected between the upright tubes of said front upright frame and the upright tubes of said rear upright frame by angle connectors, each angle connector comprising a plug hole at one end, which receives either end of either horizontal handrail, and a plug rod at an opposite end, which fits into either upright tube of either upright frame and is then fixed in position by screws, said plug hole comprising two opposite ribs respectively engaged into two opposite longitudinal grooves on either end of either horizontal handrail.

3. The step exercising machine of claim 1 wherein said first horizontal handrail comprises two screw holes spaced on an outer side thereof; said control panel comprises two mounting lugs having a respective elongated slot connected to either screw hole on said first horizontal handrail by a respective adjusting screw.

4. The step exercising machine of claim 1 wherein said rollers are turned on a respective axle having two opposite ends fixed to two opposite C-shaped holder frames on said side bars of said machine base.

5. The step exercising machine of claim 1 wherein said side bars of said machine base have a respective row of screw nuts fastened in respective holes thereof; said bottom board comprises two rows of through holes at two opposite sides respectively connected to the row of screw nuts on either side bar of said machine base by screw bolts and spring washers.

* * * * *